US012623803B1

(12) United States Patent
Dillon et al.

(10) Patent No.: US 12,623,803 B1
(45) Date of Patent: May 12, 2026

(54) SHEET CARRIER CONDITIONING DIE ASSEMBLY AND CONDITIONING METHOD

(71) Applicant: Douglas Machine Inc., Alexandria, MN (US)

(72) Inventors: Kasey W. Dillon, Alexandria, MN (US); Corey S. Sundheim, Glenwood, MN (US); Craig Sholts, Alexandria, MN (US)

(73) Assignee: Douglas Machine Inc., Alexandria, MN (US)

( * ) Notice: Subject to any disclaimer, the term of this patent is extended or adjusted under 35 U.S.C. 154(b) by 0 days.

(21) Appl. No.: 19/033,982

(22) Filed: Jan. 22, 2025

Related U.S. Application Data

(60) Provisional application No. 63/623,672, filed on Jan. 22, 2024.

(51) Int. Cl.
*B65B 47/04* (2006.01)
*B65B 17/02* (2006.01)

(52) U.S. Cl.
CPC ..... *B65B 47/04* (2013.01); *B65B 17/025* (2013.01)

(58) Field of Classification Search
USPC ..... 53/398
See application file for complete search history.

(56) References Cited

U.S. PATENT DOCUMENTS 5,791,121 A 8/1998 Bernier
11,511,895 B1 11/2022 L'Heureux et al.
11,905,052 B2 2/2024 Frederick et al.
(Continued)

FOREIGN PATENT DOCUMENTS

WO 2018/049429 A1 3/2018

OTHER PUBLICATIONS

Graphic Packaging: KeelClip (TM) Clip-Style Multipack Carton for Cans; screenshot https://www.graphicpkg.com/products/keelclip-clip-style-multipack-carton-for-cans/; accessed May 12, 2025; 4 pages; known of prior to Jan. 22, 2025.
(Continued)

*Primary Examiner* — Chinyere J Rushing-Tucker
(74) *Attorney, Agent, or Firm* — Dicke, Billig & Czaja, PLLC

(57) ABSTRACT

An assembly to effectuate conditioning of a sheet carrier for a container multi-pack is provided. The assembly includes a die plate and a sheet carrier receiver plate resiliently retained thereupon for select displacement towards same via engagement of a sheet carrier received upon the receiver plate by a press plate. The die plate includes a central portion and a central portion periphery adjacent the central portion, the die plate characterized by a select array of conditioning dies upwardly extending from the central portion of the die plate, the dies characterized by a shoulder delimiting upper and lower die portions. The sheet carrier includes a central portion and a central portion periphery adjacent the central portion which includes a select array of passages configured to correspond to a configuration of the select array of conditioning dies of the die plate. Passages of the receiver plate circumscribe the lower die portions of the conditioning dies and during sheet carrier conditioning, discrete portions of the sheet carrier manipulated about/over the shoulder/lower die portions of the dies.

21 Claims, 5 Drawing Sheets

(56) References Cited

U.S. PATENT DOCUMENTS

| | | | | |
|---|---|---|---|---|
| 2019/0233145 | A1* | 8/2019 | Kooc | B65B 17/025 |
| 2021/0039856 | A1* | 2/2021 | Chung | B65D 71/50 |
| 2022/0348368 | A1* | 11/2022 | Frederick | B65B 17/025 |
| 2022/0411114 | A1* | 12/2022 | Elliott | B65B 17/025 |
| 2025/0289602 | A1* | 9/2025 | Wittmann | B65D 71/70 |

OTHER PUBLICATIONS

Westrock; Cancollar (R) Paper based can carrier for multipacks; screenshot from https://www.westrock.com/products/folding-cartons/cancollar; accessed May 12, 2025; 3 pages; known of prior to Jan. 22, 2025.

Douglas Machine; NEXClip (TM) Sustainable Paperboard Ring Applicator for Eco-Friendly Packaging; screenshot from https://www.douglas-machine.com/products-solutions/nexclip-series/; accessed May 12, 2025; 4 pages; known of prior to Jan. 22, 2025.

* cited by examiner

SHEET CARRIER CONDITIONING DIE ASSEMBLY AND CONDITIONING METHOD

This is a United States patent application filed pursuant to 35 USC § 111 (a) claiming priority under 35 U.S.C. § 120 to U.S. Pat. Appl. Ser. No. 63/623,672 filed Jan. 22, 2024 pursuant to 35 U.S.C. § 111 (b) entitled SPRING LOADED PRE-BREAK DIE, ASSEMBLY & PRE-BREAK PROCESS, said application incorporated herein by reference in its entirety.

TECHNICAL FIELD

The present disclosure is generally directed to one or more of processes, systems, platforms, stations, apparatuses, devices, assemblies, subassemblies, and/or methods for/of conditioning a sheet carrier (e.g., a top clip) for an article container group (ACG) in furtherance of applying the conditioned sheet carrier to the ACG in furtherance of delimiting a clipped container multi-pack without a loss of integrity or aesthetic of same and/or with reduced force application of the sheet carrier to the ACG, and further still, to a sheet carrier conditioning die assembly characterized by a sheet carrier receiver plate reversibly displaceable in relation to a static die plate, more particularly still, to a sheet carrier conditioning die assembly characterized by a tensioned sheet carrier receiver plate.

BACKGROUND OF THE INVENTION

In a typical packing operation, articles approach a case packing station or the like via a flowing article stream, e.g., a continuous, semi-continuous, or batch continuous stream having origins in an upstream bulk flow of articles. As such operations/processing lines are more often than not intended to aggregate articles in multiples in furtherance of establishing an ACG or multi-pack of arrayed or otherwise grouped articles, e.g., multi-pack cases (e.g., 6, 12, 24 article packs or bundles), trays of article multi-packs, or even stacked trays of article multi-packs, etc., it is necessary to manage, prepare and generally manipulate the inflow stream of articles so as to separate the articles into groups (e.g., collated arrayed articles corresponding to a preselect pack pattern consistent with the case packing objective) as is generally well known. Once grouped or collated, the article group or set may be further processed, such as by being trayed, cased or sleeved, and/or film over-wrapped. While not so limited, articles commonly comprise containers, more particularly, beverage cans or bottles.

In light of sustainability objectives, considerable ground has been covered in relation to how consumer goods are packaged and presented, with the beverage industry being a key player. While cartoning and sleeving remain important packaging options for larger or bulkier container arrays, renewed focus has targeted smaller container groups, for example and without limitation, 4, 6, & 8 container (e.g., beverage) packs, i.e., multi-packs.

Though greatly diminished since their heyday, plastic 6-pack yokes (i.e., plastic ring carriers) to retain canned liquids/beverages nonetheless remain in a number of forms. That said, considerable effort has been directed to securing container groups in novel ways using devices having a reduced impact on the environment and its inhabitants. For example, and without limitation, adapted containers per se which are joinable as a stack, use of adhesives which connect containers of ACGs, and use of arrayed container retainers, often in the form of sheet carriers (e.g., clips, toppers), which are applied to an upper or top portion of an ACG so as to securely integrate the containers of the group for easy, efficient and reliable consumer handling as carriable multi-packs, are known, with paperboard sheet carriers being substituted for plastic carriers.

With regard to container carrying devices, numerous styles have emerged and are known. This is especially true in the case of multi-pack solutions for cans (see e.g., products of Graphic Packaging International LLC, Georgia USA (https://www.graphicpkg.com/products/keelclip/) and/or WestRock Packaging Systems LLC, Georgia USA (https://www.westrock.com/products/folding-cartons/can-collar). That said, the application of a paperboard sheet carriers, in a repeatable reliable way while maintaining carrier integrity and/or aesthetic remains a challenge owing to a minimal amount of sheet carrier material between passages and peripheries/borders thereof, and, in the case of clip application via a robotic arm end of arm tool (EOAT), increased application forces.

Applicant Douglas Machine. Inc., Minnesota MN USA presently offers a multi-pack solution for beverage containers in the form of a paperboard clip with neck rings and an applicator system for same, see e.g., https://www.douglas-machine.com/products-solutions/nexclip-series/and U.S. Pat. No. 11,905,052, the content associated with each citation hereby incorporated by reference in their entireties. Work to date has been well received, especially in the differentiated context of multi-packing/pack PET bottles. While initially having addressed front end/upstream processing, i.e., forming clipped PET bottle multi-packs, downstream processing has garnered attention, with improvements sought to better leverage/maintain upstream processing advantages that have been attained with the NEXClip™ paperboard ring applicator system. Moreover, enhancements and/or refinements to front end processing is believed advantageous, more particularly, improvements in pre-application conditioning of the clip blank/sheet carrier has been sought.

In light of the foregoing, it is believed desirable and advantageous to provide one or more of processes, methods, systems, stations, apparatuses, devices, assemblies and/or subassemblies to condition a sheet carrier blank, e.g., pre-break portions thereof to aid application to the ACG. More particularly still, to condition a sheet carrier blank via selective force application to portions of the blank (i.e., passages thereof for receipt of an upper container portion), while suitably and effectively supporting the remainder of the blank during the conditioning.

DESCRIPTION OF THE DRAWINGS

Non-limiting depictions for representative platforms and/or workstations and contemplated assemblies, apparatus, etc., part-and-parcel of same, are set out herewith and hereinafter in connection to FIG. 1 on one hand, and FIGS. 2-5 on the other hand wherein.

SUMMARY OF THE INVENTION(S)

Figure 1:
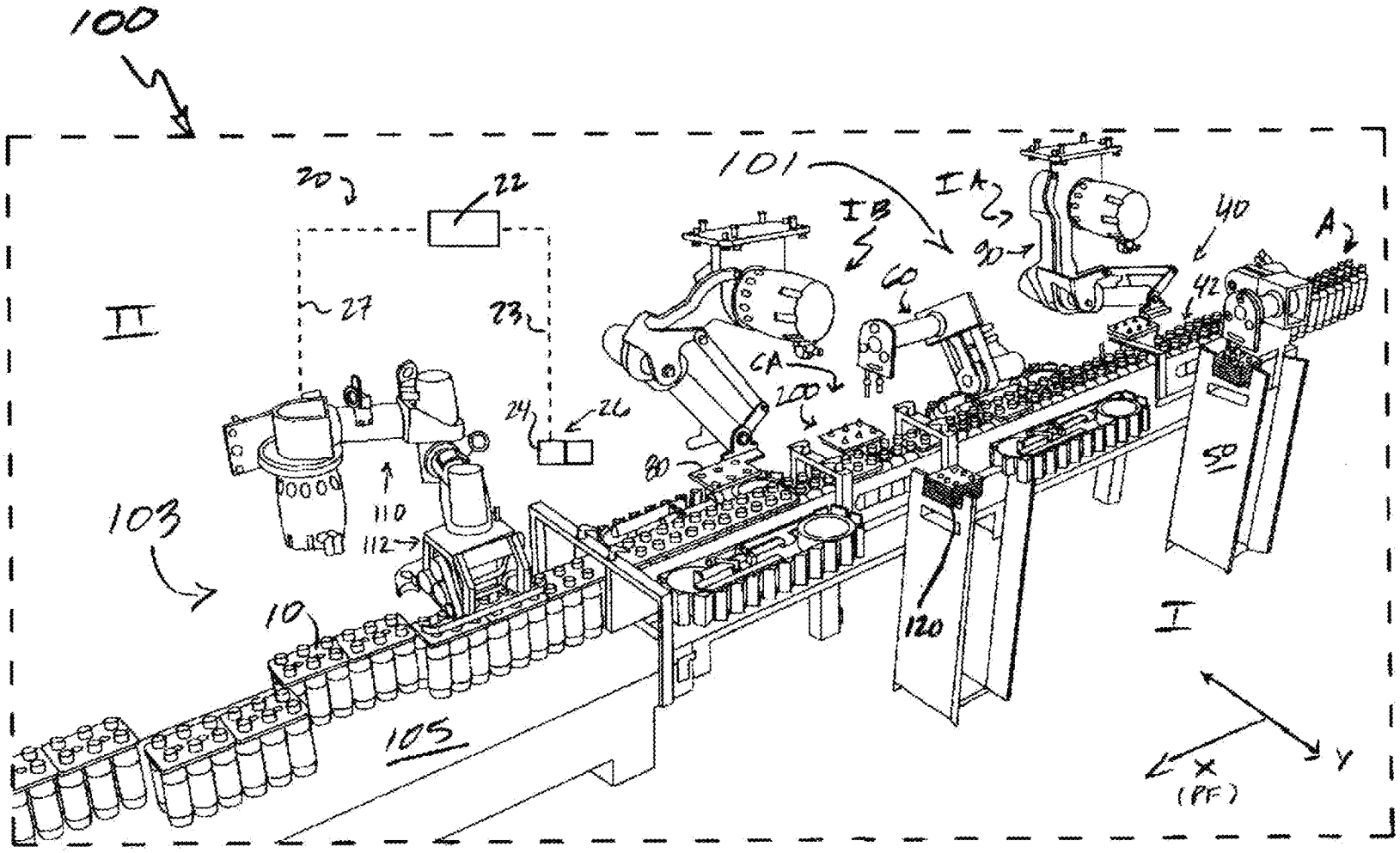
FIG. 1 depicts, perspective side elevation view from above, process flow right to left, an illustrative, non-limiting sheet carrier (blank) applicator/system/platform characterized by first and second sheet carrier conditioning stations, each station equipped with a sheet carrier conditioning die assembly and a robotic arm EOAT for cooperation engagement therewith in furtherance of sheet carrier conditioning and subsequent transfer and application of the conditioned sheet carrier to an ACG to form a clipped multi-pack.

An assembly to effectuate conditioning of a sheet carrier prior to application of the sheet carrier to an ACG so as to form a container multi-pack is generally provided. The assembly includes a die plate and a sheet carrier receiver plate resiliently retained upon the die plate for select displacement towards the die plate via engagement of a sheet carrier received upon the sheet carrier receiver plate by a press plate. Advantageously, but not necessarily, the contemplated press plate is embodied in an EOAT of a robotic arm.

The die plate of the conditioning assembly includes a central portion and a central portion periphery adjacent the central portion. The central portion of the die plate is characterized by a select array of conditioning dies which upwardly extending from the central portion of the die plate. The dies are characterized by a shoulder delimiting upper and lower die portions.

The sheet carrier receiver plate of the conditioning assembly includes a central portion and a central portion periphery adjacent the central portion. The central portion of the sheet carrier receiver plate is characterized by a select array of passages configured to correspond to a configuration of the select array of conditioning dies of the central portion of the die plate. The passages of the select array of passages circumscribe the lower die portions of the conditioning dies. During sheet carrier conditioning, discrete portions of the sheet carrier are manipulated, for instance as by deflecting or bending, about and over the shoulder of the dies while remaining/adjacent sheet carrier portions are otherwise retained in an interposed/supported condition between the conditioning die assembly and the press plate, more particularly, the displaced sheet carrier receiver plate and the press plate.

The conditioning assembly is further characterized by tensioning elements interposed between the sheet carrier receiver plate and the die plate. Select displacement of sheet carrier receiver plate compressing the tensioning elements as the receiver plate is displaced towards the die plate. More particularly, grouped tensioning elements are provided. A first tensioning element group is interposed between the central portion of the sheet carrier receiver plate and the central portion of the die plate. A second tensioning element group is interposed between the central portion periphery of the sheet carrier receiver plate and the central portion periphery of the die plate.

The conditioning assembly is yet further characterized by sheet carrier receiver plate support assemblies for supporting the sheet carrier receiver plate in a spaced apart condition over the die plate, The die plate is adapted to retain the sheet carrier receiver plate support assemblies. More particularly, a housing of the sheet carrier receiver plate support assemblies is retained by the die plate, a post within the housing supporting the sheet carrier receiver plate, the post displaceable within the housing.

The dies of the select array of conditioning dies generally comprise a cylindrical base, and a tapering segment, or segments, extending therefrom, each corresponding to lower and upper die portions respectively. The cylindrical base of the die, and shoulder thereof, are circumscribed by passages of the select array of passages of the central portion of the resilient retained sheet carrier receiver plate.

As to the contemplated sheet carrier conditioning station, in addition to being characterized by the sheet carrier conditioning die assembly, it is further fairly characterized by a press plate, advantageously, but not necessarily, embodied in the form of a robotic arm EOAT. The EOAT, in addition to effectuating the press function, advantageously, but not necessarily, functions to secure the conditioned sheet carrier and remove it from the sheet carrier conditioning die assembly and thereafter advantageously apply same to an ACG in furtherance of forming a container multi-pack.

Finally, as to sheet carrier conditioning, the methodology contemplates, among other things, an advantageous and desirable sandwiched retention of the sheet carrier between the press plate and sheet carrier receiver plate whilst a press plate displaces the combination of the carrier and receiver plate over and upon dies of the select array of conditioning dies of the die plate. Thusly, aperture margins of the sheet carrier blank are exclusively manipulated via passage over the die shoulder of the dies of the select array of conditioning dies, more particularly, for example, tabs or the like (i.e., sheet carrier elements circumferentially disposed about apertures thereof), are initially stressed so as to enable swift and reliable application to the ACG without degrading the carrier, either functionally or aesthetically. More specific features and advantages obtained in view of the summarized process/system features will become apparent with reference to the drawing figures and DETAILED DESCRIPTION.

DETAILED DESCRIPTION

In advance of particulars for the contemplated sheet carrier conditioning assembly and attendant sheet carrier conditioning station, a brief overview of the instant description is provided. A representative, non-limiting processing system for forming container multi-packs (i.e., retained ACGs) via application of a sheet carrier (e.g., top clip retainer blanks)/conditioned sheet carriers) to ACGs is generally shown FIG. 1. A brief contextual overview of the system follows to inform sheet carrier conditioning station operations, with particulars for/of advantageous, non-limiting sheet carrier conditioning station elements thereafter set out FIG. 2, with particulars for the contemplated cooperative station elements, namely the conditioning assembly, FIGS. 3 & 4, and robotic arm EAOT for engaging a loaded conditioning assembly, FIG. 5, thereafter taken up.

Referring now generally to FIG. 1, an advantageous, non-limiting modular system or platform 100 is shown, process flow right to left wherein container clipping related operations 101 and downstream multi-pack displacement operations 103 are executed or undertaken in respect of processing stations I & II respectively. The depicted system advantageously contemplates continuous motion processing, however, adaptations of the depicted system are likewise contemplated for intermittent motion processing. Moreover, while a "flat" retainer or sheet carrier in the form of a "flat clip" is contemplated in relation to the depicted system, system elements, stations or assemblies, adaptations of the depicted system are likewise contemplated for forming container multi-packs via application of alternately configured or styled sheet carriers, for example and without limitation "fold" or banner retainers in the form of a "fold clip."

Notionally, and as is generally depicted, system 100 is fairly characterized by a container conveyor apparatus 40 for conveying ACGs (A) in a process flow direction, a supply of sheet carrier blanks, in the form of a magazine 50, from which sheet carrier blanks 120 are dispensable, a first processing station I, (i.e., IA & IB indicated) for container multi-pack formation, and a second processing station II for container multi-pack laning, and a transfer apparatus or assembly 60 for delivering a sheet carrier blank to the processing station. As will be later detailed, the processing station is fairly characterized by a segment 42 of container conveyance apparatus 40 and a die block in the form of a sheet carrier blank conditioning assembly 200. A mating punch plate for the die block is embodied in an EOAT 80 carried by a robotic arm 90. The robotic arm is operable so as to selectively position the EOAT within the processing station, the EOAT positionable for urged engagement with a dispensed sheet carrier blank received by the conditioning assembly so as to condition and secure the conditioned sheet carrier blank, the robotic arm thereafter positionable to register the secured conditioned sheet carrier blank carried by the EOAT with an ACG conveyed on the container conveyance apparatus segment of the processing station. The robotic arm is further positionable to apply the secured conditioned sheet carrier blank to the registered ACG to thereby form at least a single container multi-pack 10.

Container conveyance apparatus 40 is provided for conveying ACGs in a process flow or processing direction as indicated (PF→, +x-direction of the x, y, z coordinate system indicated). The apparatus is generally characterized by an endless flighted belt and a suitable belt drive assembly, however, the contemplated system in all its forms need not be so limited. While the ACGs may be trayed or otherwise characterized by a bounded foot-print, contemplated processing need not be limited to such characterization.

As to ACG formation, known or adapted processes to effectuate same are believed generally suitable. Notionally, in the context of the contemplated systems and processes, an ACG is considered a work piece. While a variety of ACG formation processes may be suitable, those supplementing the small operational footprint of, for instance, the FIG. 1 system, is believed desirable. Moreover, while not shown, a squaring assembly may be provided as processing circumstances and objectives warrant, see e.g., Applicant's U.S. Pat. No. 11,905,052 as referenced in the BACKGROUND section.

As to the supply of sheet carrier blanks, and in the context of the FIG. 1 system, magazine 50 comprises a vertical magazine adjacent container conveyance apparatus 40, more particularly, but not necessarily, spaced apart in the z-direction from processing station container conveyance apparatus segment 42 and in x-direction alignment with a conditioning area (CA) of station I delimited by the sheet carrier blank conditioning assembly 200. As should be readily appreciated, the magazine configuration, vertical or horizontal, and its placement relative to the processing station and/or container conveyance apparatus may be suitably varied as circumstances warrant, such specification and/or illustrated relationships intended to be generally supportive of a minimal/minimized footprint for undertaking the sought after processing. Moreover, it is further contemplated that the magazine be refillable on-the-fly (i.e., without processing disruption). Towards this end, for example, the magazine may be characterized by a working queue and a secondary queue, the secondary queue formable during dispensing retainer blanks from the working queue, as by, for example, a dedicated loader for that purpose.

Notionally, a control system 20 for inspection, detection and signaling redirection of detected off-spec clipped container multi-packs is advantageously provided. The detection of clips that have not been applied correctly are common, for example and without limitation, clips may not be fully seated, or multiple clips may be inadvertently grabbed with neither suitably seated upon the ACG. Removal of such detected off spec container multi-packs is important so that issues can be corrected, and downstream problems prevented. Heretofore, the jettisoning or removal occurs with a mechanical or electromechanical device separate and apart from the lane dividing apparatus and/or rotating feature that pushes the off-spec container multipack to a lane connected to chute (diverter) that prevents it from continuing to downstream processes.

Control system 20 is fairly characterized by a controller 22 for receiving a detection signal 23 from a detector 24 associated with an inspection device/apparatus 26 and for issuing a divert signal 27 to a robotic mover of station II of system 100. Upon receipt of a divert signal, the robotic mover displacingly diverts the off-spec container multi-pack to a rejected product position that delimits a rejected product lane so that appropriate intervention/diagnostic may be undertaken. Such control system is amenable to ready adaptation as circumstances warrant.

Processing station II is fairly characterized by a container multi-pack conveyor 105 and at least a single robotic mover 110 equipped with an EOAT 112. As to process, container multi-packs may be readily received upon the multi-pack conveyor for displacement and, and/or takeaway, or the multi-packs may be received upon a table, deadplate or other station related device in advance of or for displacement operations prior to displaced multi-pack takeaway. As to apparatus to effectuate retention of a container multi-pack, a specially configured EOAT is contemplated and desirable. That said, pneumatic tools, in addition to alternate mechanical tools, may be suitably employed part-and-parcel of the robotic mover. Finally, as to the station, advantageously, but not necessarily, the robotic mover takes the form of a robotic arm, more particularly, a selective compliance articulated robot arm (SCARA) as shown to effectuate either of translational displacement or rotational displacement of the container multi-packs in furtherance of lane dividing same. While the SCARA is shown in a preferred posture or orientation relative to other station and/or system elements (i.e., overhead), it likewise need not be so limited.

Figure 2:
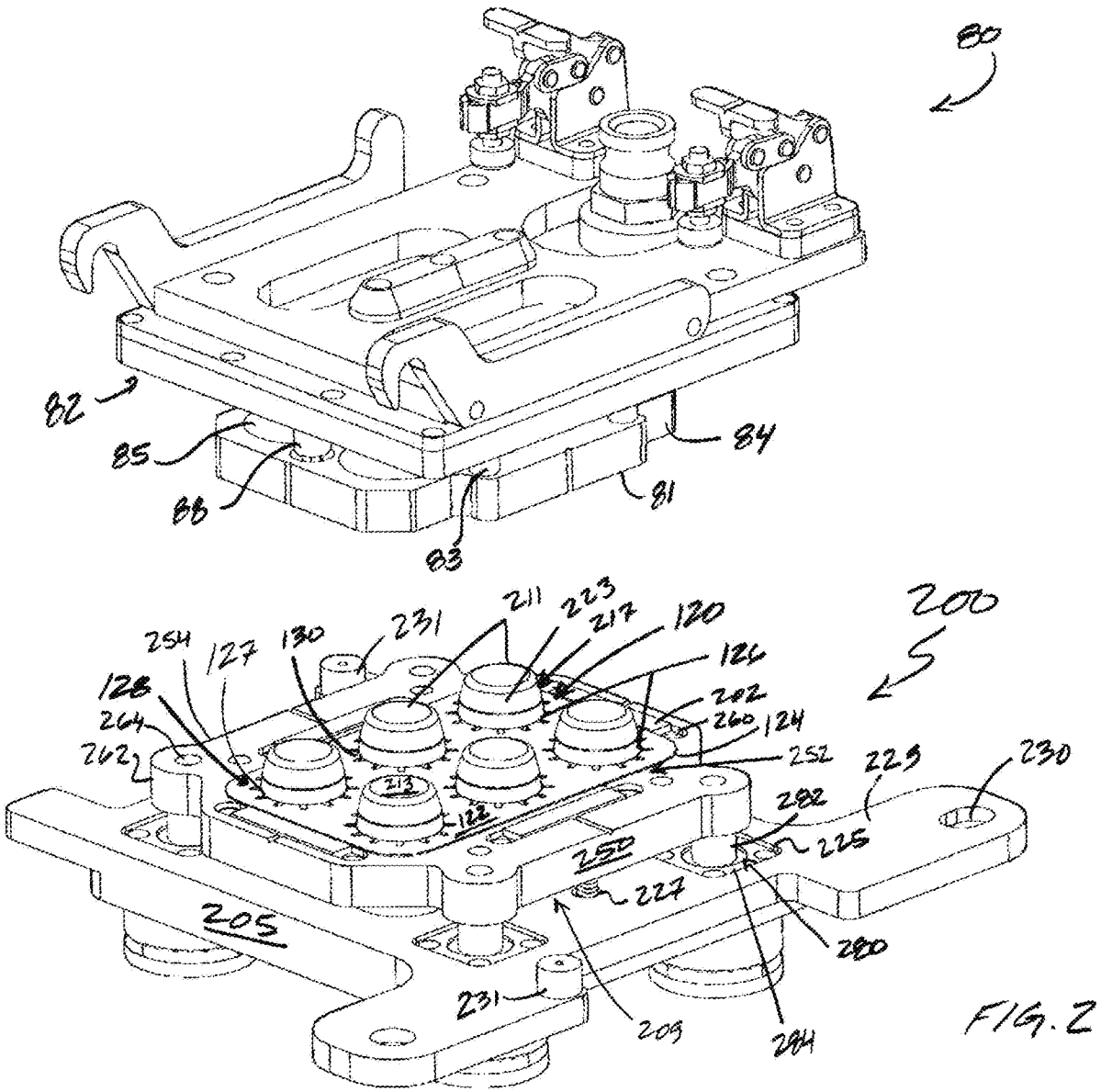
FIG. 2 depicts, perspective elevation view from above, an advantageous, non-limiting sheet carrier conditioning die assembly of the FIG. 1 conditioning station, in operative combination with a sheet carrier blank, and an advantageous, non-limiting robotic arm EOAT, in a spaced apart condition thereover, for engagement with the sheet carrier of the loaded sheet carrier conditioning die assembly.

Referring now initially and briefly to FIG. 2, an advantageous non-limiting sheet carrier conditioning die assembly 200 is depicted, in a loaded state or condition (i.e., in operative combination with a sheet carrier/carrier blank 120), along with an advantageous, non-limiting robotic arm EOAT 80 depicted thereover for selectively engaging the loaded carrier blank of the as-shown sheet carrier conditioning assembly, more particularly, a press plate 84 thereof. While each of these cooperating assemblies will be sequentially detailed hereinafter, some preliminary general observations are warranted, first, in relation to the sheet carrier (i.e., a workpiece) and second, in relation to the assemblies to effectuate sought after conditioning as an advantageous expedient to sure, repeatable, in spec application of the sheet carriers to the ACGs so as to reliably form aesthetically pleasing container multi-packs wherein each of the containers of the ACGs is suitably and reliably retained.

As to the workpiece, sheet carriers in the form of "clips" are well known packaging structures for aggregating and carrying containers, most commonly, beverage containers, i.e., cans or bottles. Notionally, such structures replaced plastic rings and are intended to reduce/replace bundling via plastic shrink wrap. Typically, and desirably, such structures are a paper-based packaging, fully renewable, recyclable and biodegradable, formatted as a blank for adaptive integration with an ACG (i.e., each container of the ACG), commonly comprised of 2×2, 3×2, or 4×2 container arrays, so as to delimit a multi-pack.

An illustrative, non-limiting clip blank 120 is depicted in operative combination with the conditioning assembly 200 (FIG. 2). Notionally, the blank comprises a substantially flat sheet material 122 and is fairly characterized by a periphery 124 and an array of apertures 126 (e.g., a 3×2 aperture array as shown) comprised of apertures 127 for the select receipt and passage of a portion of containers of an ACG. Adjacent each aperture 127 is a margin, more particularly, a circumferential margin 128. Advantageously, aperture margins 128 of clip blank 120, at least portions thereof, are adapted for engagement (i.e., clipped engagement) with containers of the ACG so as to form a carriable multi-pack package. For instance, via inclusion of cuts, lines of weakness (e.g., score or perforation lines), or select removal of sheet material, elements for forming an interference fit with containers of the ACG are delimited, for instance, tabs 130 as shown for aperture margins 128 of clip blank 120. As will be subsequently taken up, the cooperative engagement of the FIG. 2 assemblies (i.e., the robotic arm EOAT and sheet carrier conditioning assembly) act upon a suitably loaded sheet carrier interposed therebetween to effectuate a focused conditioning, e.g., a tensioning or pre-stressing, of the aperture margins thereof while insulating the remainder of the sheet material of the sheet carrier blank from the conditioning directed to the aperture margin.

As to the assemblies to effectuate blank conditioning, it is to be generally noted and understood that the depictions of FIG. 2 are illustrative, further still, the depictions of FIG. 2 are illustrative of a 3×2 ACG array, even further still, the depictions of FIG. 2 are illustrative of a 3×2 ACG array of cans. Moreover, it is to be noted and understood that the conditioning assembly, and/or elements thereof are advantageously provided in the form of a change part(s). Commensurately, the robotic arm EOAT, and/or elements thereof, are likewise advantageously provided in the form of a change part. Further still, it is to be noted and understood that depicted dies of the contemplated die plate of the conditioning die assembly, while believed advantageous in their configuration/form, need not be so limited. Finally, further suitable structural departures/adaptations will be readily appreciated in connection to the subsequent description of the illustrative non-limiting FIG. 2 assemblies.

With renewed reference to FIG. 2, sheet carrier conditioning die assembly 200 is advantageously characterized by a die plate 205, a sheet carrier receiver plate 250 overlying same in spaced apart tensioned condition, support assemblies 280 for retaining receiver plate 250 in the spaced apart condition, and tensioning elements 290 interposed between sheet carrier receiver plate 250 and die plate 205. Sheet carrier receiver plate 250 is resiliently retained by/upon die plate 205 for reversible displacement of sheet carrier receiver plate 250 towards die plate 250 via engagement of a sheet carrier received upon sheet carrier receiver plate 250 by press plate 84 of EOAT 80 in furtherance of conditioning the received sheet carrier, more particularly, deflecting/bending discrete portions thereof, namely, aperture margins 128 of the received sheet carrier blank, for example tabs 130 thereof.

Notionally, and in keeping with the illustrative FIG. 1 clipping platform, robotic arm 90 directs EOAT 80 to the loaded conditioning assembly wherein press plate 84 of EOAT 80 is aligningly positioned for pressing or plunging the combined sheet carrier and sheet carrier receiver plate 250 towards die plate 205, dies 213 of array of conditioning dies 211 of die plate 205 received by apertures of the sheet carrier so as to effectuate sheet carrier conditioning during press plate pressing/plunging, EOAT 80 thereafter securing the conditioned sheet carrier for travel by robotic arm 90 in furtherance of applying the conditioned sheet carrier to an ACG.

Figure 3:
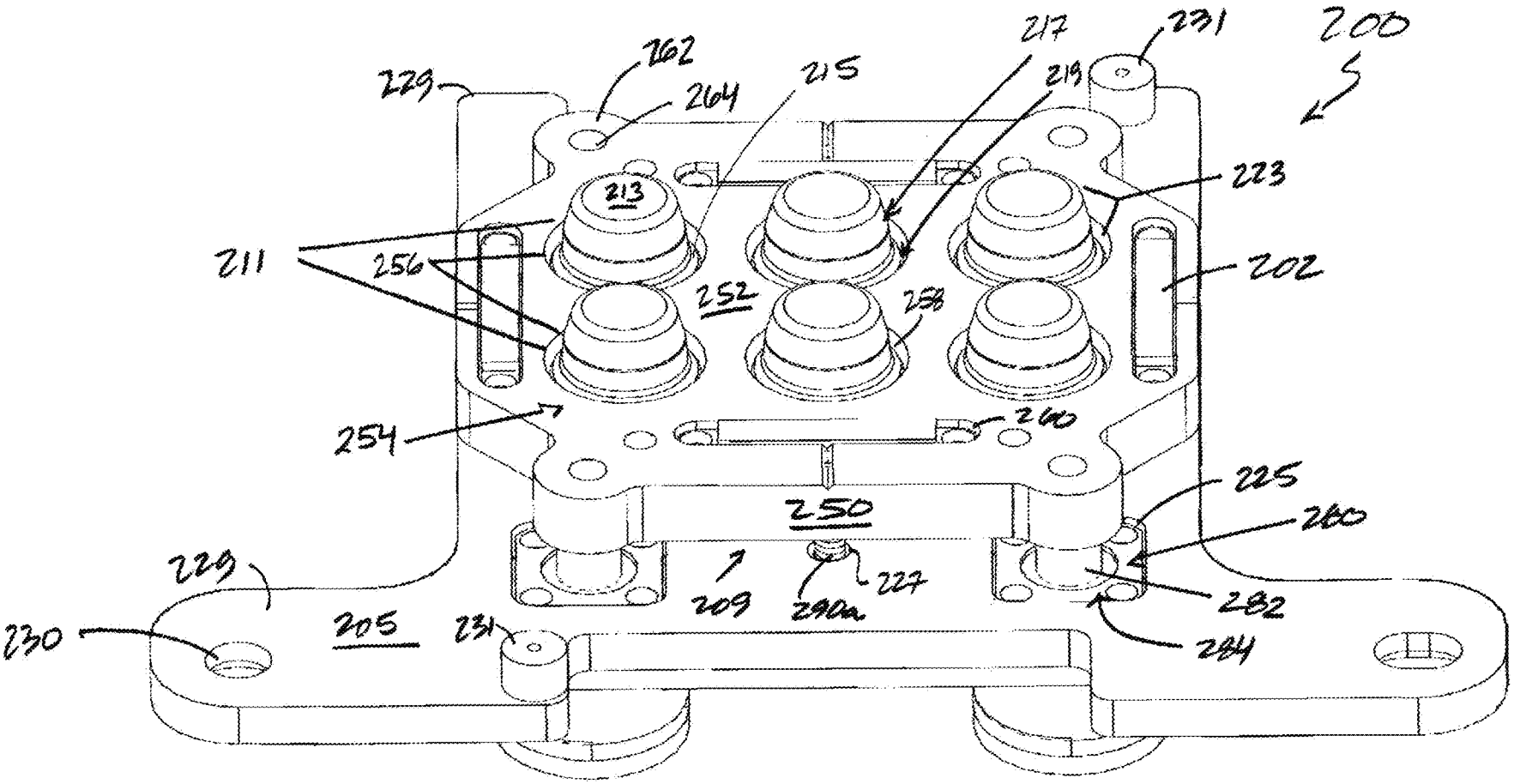
FIG. 3 depicts, front elevation, the sheet carrier conditioning assembly of FIG. 2, the sheet carrier absent.
Figure 4:
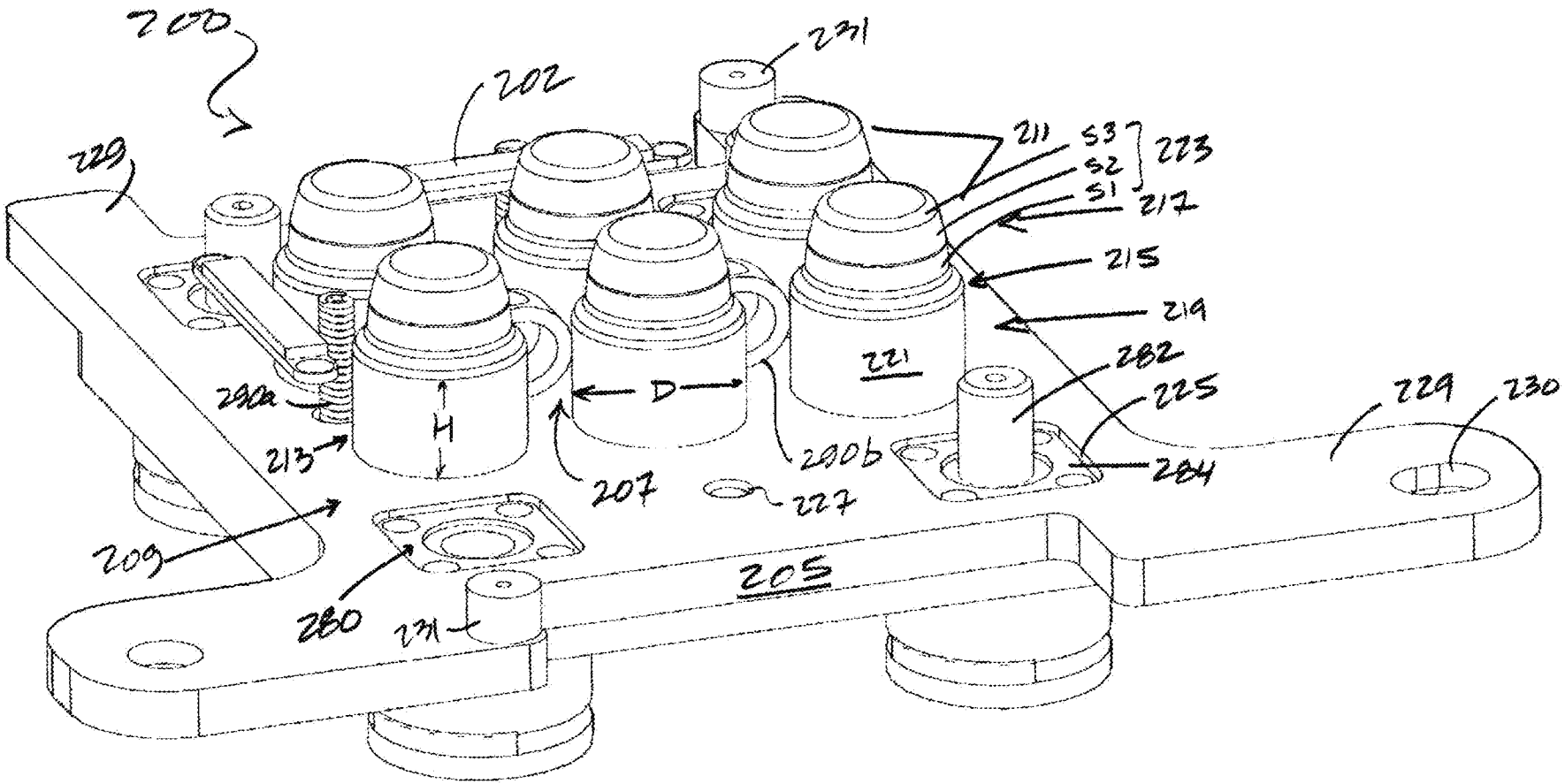
FIG. 4 depicts, front elevation, the sheet carrier conditioning assembly of FIG. 3, a sheet carrier receiving plate and further select assembly portions eliminated to reveal underlying assembly particulars; and, FIG. 5 depicts, front elevation from below, the FIG. 2 EOAT.

Referring now to FIGS. 2, 3 & 4, die plate 205 generally includes a substantially flat central portion 207 and a central portion periphery 209 adjacent central portion 207. Central portion 207 of die plate 205 is characterized by select array of conditioning dies 211 comprised of dies 213, die array 211 corresponding to the sheet carrier aperture array for a given multi-pack operation. Dies 213 of select array of conditioning dies 211 upwardly extend from central portion 207 of die plate 205 and are generally characterized by a shoulder 215 which delimits upper 217 and lower 219 die portions, upper die portion 217 advantageously tapering toward a free end thereof.

As best appreciated with reference to FIG. 4, lower die portion 219 comprises a cylindrical base 221 characterized by height H and diameter D, with upper die portion 217 characterized by one or more tapering segments 223, for example and without limitation, tapering segments S1, S2 & S3 as shown. As to taper or tapering segments 213, taper segment S1 is adjacent shoulder 215 of/for die, taper segment S3 delimits a free end portion of the die, and taper segment S2 is intermediate the other segments as shown/indicated.

Central portion periphery 209 of die plate 205 is advantageously characterized by passages 225 for receipt of receiver plate support assemblies 280, and surface cavities 227 for receipt/retention of select tensioning elements of the assembly, e.g., compression springs 290*a* as shown. Support assembly passages 225, and thus support assemblies 280, generally delimit the areal extent of central portion periphery 209 of die plate 205 with surface cavities 227 opposingly paired and positioned intermediate support assemblies 280. Notionally, support assemblies 280, which include a post 282 extending from a housing 284, the posts displaceable with respect thereto, are integrally received/retained by die plate passages 225 of die plate 205. Posts 282 operatively receive sheet carrier receiver plate 250 and are affixed thereto.

Finally, in connection to the depicted die plate, it is further fairly characterized by paired tabs 229, fore and aft, to effectuate support of the assembly in relation to structural elements of the conditioning station. A tab of the paired tabs advantageously includes a landing 231 for a toggle or the like for affixation of the assembly to the structural elements of the conditioning station with the front tabs each including an aperture 230 for receipt of a positioner such that the conditioning assembly is suitable aligned/seated for securing the conditioning assembly within the workstation via the toggle or the like. It is to be appreciated and understood that other suitable die plate adaptations may be adopted to effectuate positioning and affixation of the assembly in relation to the workstation.

Sheet carrier receiver plate 250 generally includes a substantially flat central portion 252 and a central portion periphery 254 adjacent central portion 252. Central portion 252 of sheet carrier receiver plate 250 is characterized by a select array of passages 256, comprised of passages 258, configured to correspond to the configuration of select array of conditioning dies 211 of central portion 207 of die plate 205. Receiver plate passages 258 are advantageously characterized by a diameter that substantially corresponds to diameter D of base 221 of dies 205, passages 258 thereby circumscribing 221 bases and shoulders 215 of dies 213. Upper die portion 217 of conditioning dies 213 of array 211 of die plate 205 advantageously extend above a surface of central portion 252 of resiliently retained sheet carrier receiver plate 250. Upper die portions 217 guidingly register and receive the sheet carrier blank upon transfer of it into the conditioning assembly.

Central portion periphery 252 of receiver plate 250 is advantageously characterized by surface cavities 260. Opposingly paired upper surface cavities essentially delimit the areal extent of central portion periphery 252. These cavities are adapted to retain resilient elements of the assembly, more particularly, elastomeric bars 202 as shown, a surface of bar 202 marginally extending above the upper surface of central portion periphery 254 of receiver plate 250. As is appreciated with reference to FIG. 2, a suitably loaded sheet carrier blank is positioned interior of the area delimited by the opposingly paired upper surface cavities/elastomeric bars, the elastomeric bars being essentially flush with the loaded sheet carrier blank.

Opposingly paired lower surface cavities (not shown) receive/retain an end of compression springs 290*a* of the conditioning assembly interposed between receiver plate 250 and die plate 205, receiver plate lower surface cavities positionally corresponding to the upper surface cavities 260 of die plate 205. A first lower surface cavity pair is advantageously, but not necessarily, positioned interior of elastomeric bars 202 (i.e., surface cavities for same) with a second lower surface cavity pair positioned exterior of the elastomeric bars (i.e., surface cavities for same).

Finally as to sheet carrier receiver plate 250, it is further fairly characterized by corner tabs 262 having through holes 264. Fasteners (not shown), received by posts 282 of support assemblies 280, unite/reversibly unite receiver plate 250 with die plate 205.

As has been previously noted, the conditioning assembly is characterized by tensioning elements. In addition to compression springs 290*a* for tensioning the receiver plate relative to the die plate, in furtherance of the resilient retention of same in relation to the die plate, and elastomeric members 202 retained by the receiver plate, inclusion of further tension elements are advantageously, but not necessarily contemplated, for instance, one or more elastomeric rings 290*b* as shown. Paired elastomeric rings 290*b* are centrally disposed for imposition between receiver 250 and die plates 205, more particularly, the paired elastomeric rings are disposed within die array 211 and affixed to die plate 205 in upward extension (FIG. 3).

Figure 5:
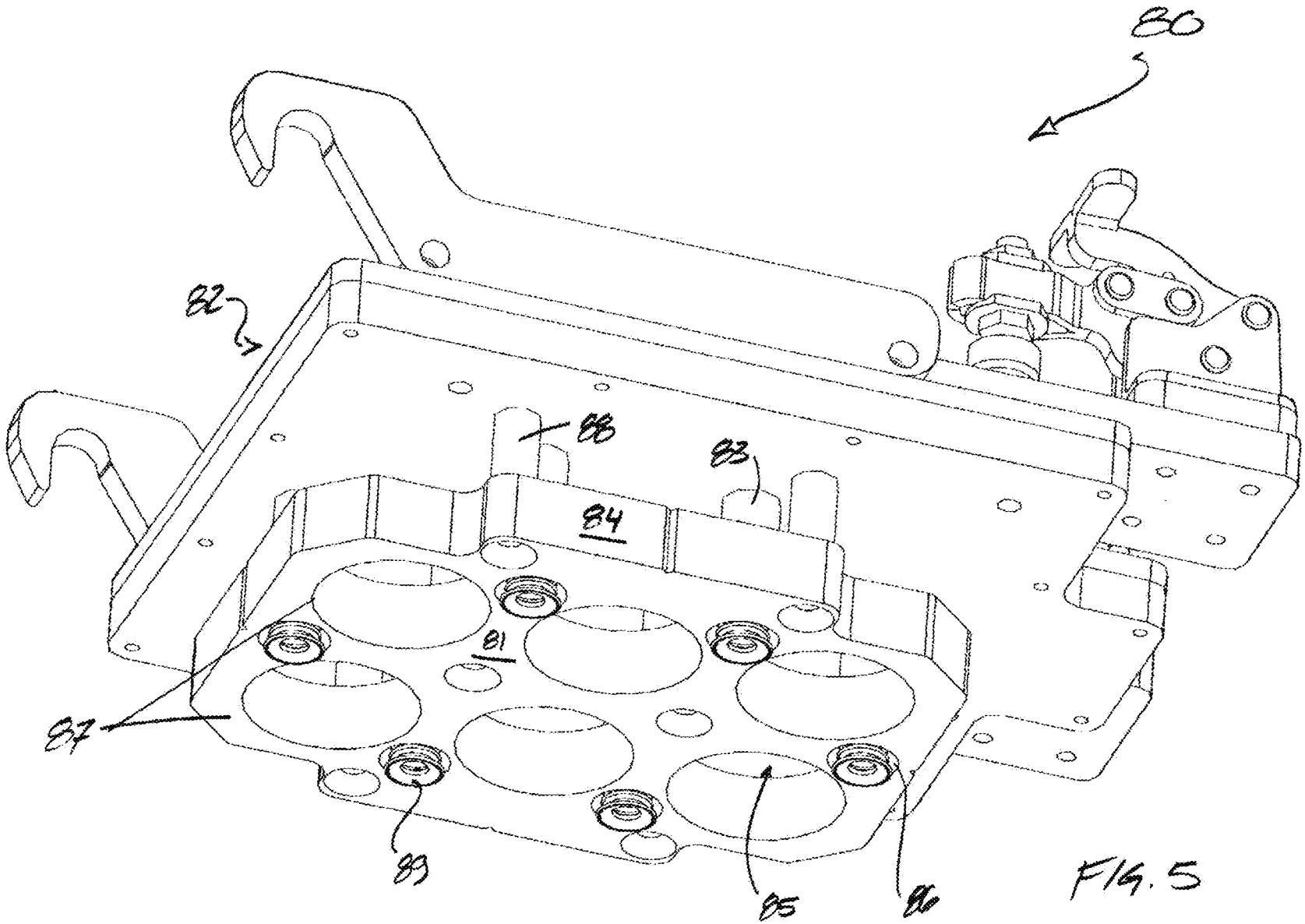

Referring now to FIG. 5, an advantageous robotic arm EOAT for operative union with the FIG. 3 sheet carrier conditioning die assembly is shown. EOAT 80 is fairly and generally characterized by a structural assembly 82 and depending press plate 84.

Press plate 84 extends from an element of the structural assembly 82 in a spaced apart, fixed condition in relation thereto via posts 83 which unite those elements. Press plate 84 includes a substantially flat surface or surface portion 81 and includes primary 85 and secondary 86 through holes or passages, primary passages 85 part-and-parcel of an array of press plate passages 87.

Array of primary press plate passages 87 corresponding to the array configurations of the dies of the die plate/apertures of the sheet carrier blank. Primary passages 87 are characterized by a diameter that substantially corresponds to diameter D of base portion 221 of dies 205. During press plate engagement with a sheet carrier blank suitably received upon the receiver plate, the aperture margins of the sheet carrier are plunged over the shoulders of the die of the die plate as the receiver plate is downwardly displaced, with the resulting deflected or bent tabs thereof contacting a surface of die base/lower die portion.

Secondary press plate passages 86 house elements of a pneumatic (i.e., vacuum) system, the EOAT suitably adapted to supply a vacuum to the elements. More particularly, a vacuum conduits 88 extend through secondary passages 86, free ends thereof terminating in grippers 89 positioned to extend beyond a surface of the press plate in furtherance of operative engagement and retention of a conditioned sheet carrier. Upon select displacement of the sheet carrier/receiving plate combination by the press plate relative to the die plate, retraction of the EOAT effectuates a return of the receiver to its tensioned position relative to the die plate with the gripped conditioned sheet carrier traveling with the robotic arm EOAT for subsequent application to an ACG in furtherance of establishing a container multi-pack.

What has been described and depicted herein are preferred, non-limiting embodiments of Applicant's subject matter, along with one or more application contexts. Since the structures of the assemblies, subassemblies, and/or mechanisms disclosed herein may be embodied in other specific forms without departing from the spirit or general characteristics thereof, some of which forms have been indicated, the embodiments described and depicted herein/with are to be considered in all respects illustrative and not restrictive. Moreover, while nominal processing has been described and detailed, and to some degree alternate work pieces and systems, assemblies, etc. with regard thereto referenced, contemplated system and/or processes are not so limited. Accordingly, the scope of the subject invention is as defined in the language of the appended claims and includes not insubstantial equivalents thereto.

That which is claimed:

1. An assembly to effectuate conditioning of a sheet carrier prior to application of the sheet carrier to an article container group so as to form a container multi-pack, the assembly comprising:

a. a die plate having a central portion and a central portion periphery adjacent said central portion, said central portion of said die plate characterized by a select array of conditioning dies, dies of said select array of conditioning dies upwardly extending from said central portion of said die plate, said dies of said select array of conditioning dies characterized by a shoulder delimiting upper and lower die portions; and, b. a sheet carrier receiver plate resiliently retained upon said die plate for displacement towards said die plate via engagement of a sheet carrier received upon said sheet carrier receiver plate by a press plate in furtherance of deflecting discrete portions of the sheet carrier about shoulders of the conditioning dies of said select array of conditioning dies, said sheet carrier receiver plate having a central portion and a central portion periphery adjacent said central portion, said central portion of said sheet carrier receiver plate characterized by a select array of passages configured to correspond to a configuration of said select array of conditioning dies of said central portion of said die plate, the passages of said select array of passages circumscribing the lower die portions of the conditioning dies of said select array of conditioning dies of said central portion of said die plate.

2. The assembly of claim 1 further comprising tensioning elements, said tensioning elements interposed between said sheet carrier receiver plate and said die plate, select displacement of said sheet carrier receiver plate compressing said tensioning elements.

3. The assembly of claim 1 further comprising grouped tensioning elements, a first tensioning element group interposed between said central portion of said sheet carrier receiver plate and said central portion of said die plate.

4. The assembly of claim 1 further comprising grouped tensioning elements, a first tensioning element group interposed between said central portion of said sheet carrier receiver plate and said central portion of said die plate, a second tensioning element group interposed between said central portion periphery of said sheet carrier receiver plate and said central portion periphery of said die plate.

5. The assembly of claim 1 further comprising sheet carrier receiver plate support assemblies for supporting said sheet carrier receiver plate in a spaced apart condition over said die plate, said die plate adapted to retain said sheet carrier receiver plate support assemblies.

6. The assembly of claim 5 wherein said sheet carrier receiver plate support assemblies comprise a housing and a post housed therein, said sheet carrier receiver plate affixed to an end of said post.

7. The assembly of claim 5 wherein said sheet carrier receiver plate support assemblies comprise a housing and a post housed therein, said sheet carrier receiver plate affixed to an end of said post, said post displaceable relative to said housing.

8. The assembly of claim 1 wherein dies of said select array of conditioning dies comprise a cylindrical base portion and a tapering portion extending therefrom.

9. The assembly of claim 1 wherein lower die portions of the conditioning dies of said select array of conditioning dies comprise a cylindrical base.

10. The assembly of claim 1 wherein lower die portions of the conditioning dies of said select array of conditioning dies comprise a cylindrical base, said cylindrical base circumscribed by passages of said select array of passages of said central portion of said sheet carrier receiver plate.

11. The assembly of claim 1 wherein lower die portions of the conditioning dies of said select array of conditioning dies comprise a cylindrical base, said cylindrical base and said shoulder of the dies circumscribed by passages of said select array of passages of said central portion of the resilient retained sheet carrier receiver plate.

12. The assembly of claim 1 wherein upper die portions of the conditioning dies of said select array of conditioning dies comprise a tapering segment.

13. The assembly of claim 1 wherein upper die portions of the conditioning dies of said select array of conditioning dies comprise tapering segments.

14. The assembly of claim 1 wherein lower die portions of the conditioning dies of said select array of conditioning dies comprise a cylindrical base and upper die portions of the conditioning dies of said select array of conditioning dies comprise tapering segments.

15. The assembly of claim 1 in operative combination with a press plate.

16. The assembly of claim 1 in operative combination with a press plate of a robotic arm EOAT.

17. The assembly of claim 1 embodied as a change-part.

18. A sheet carrier conditioning station for forming container multi-packs from retained article container groups characterized by the assembly of claim 1.

19. The sheet carrier conditioning station of claim 18 further characterized by a press plate for engaging, in combination, a sheet carrier received upon said sheet carrier receiver plate.

20. The sheet carrier conditioning station of claim 18 further characterized by a robotic arm equipped with and end of arm tool having a press plate, the press plate for engaging, in combination, a sheet carrier received upon said sheet carrier receiver plate.

21. In a method of conditioning a sheet carrier prior to application of a conditioned sheet carrier to an article container group so as to form a container multi-pack, a step of sandwichingly retaining a sheet carrier between a press plate and a sheet carrier receiver plate resiliently retained upon a die plate of a sheet carrier conditioning assembly whilst the press plate displaces the combination of the sheet carrier and the sheet carrier receiver plate over and upon dies of a select array of conditioning dies of the die plate in furtherance of manipulating aperture peripheries of the sheet carrier.

* * * * *